US006005465A

United States Patent [19]

Kronenberg et al.

[11] Patent Number: 6,005,465

[45] Date of Patent: Dec. 21, 1999

[54] COIL ASSEMBLY AND METHOD FOR CONTACTING THE COIL ON A SUPPORT BODY

[75] Inventors: Klaus Kronenberg, Sulzbach; Sabine Vorberg, Aschaffenburg; Markus Keutz, Rossdorf; Andreas Wilhelm, Mühltal; Frank Weiand; Christian Beckhaus, both of Darmstadt; Thomas Vorberg, Aschaffenburg; Peter Schmidt, Bad Homburg; Jochen Blume, Darmstadt, all of Germany

[73] Assignee: VDO Adolf Schindling AG, Frankfurt, Germany

[21] Appl. No.: 08/731,650

[22] Filed: Oct. 17, 1996

[30] Foreign Application Priority Data

Oct. 20, 1995 [DE] Germany ..... 195 39 137
Apr. 23, 1996 [DE] Germany ..... 196 16 078

[51] Int. Cl.[6] ..... H01F 27/06; H01F 27/30

[52] U.S. Cl. ..... 336/192; 336/208; 336/65

[58] Field of Search ..... 336/65, 192, 208

[56] References Cited

U.S. PATENT DOCUMENTS

| | | | |
|---|---|---|---|
| 3,581,260 | 5/1971 | Andreis | 336/192 |
| 3,663,914 | 5/1972 | Lane | 336/192 |
| 4,546,340 | 10/1985 | Kuchuris | 336/192 |
| 4,759,120 | 7/1988 | Bernstein | 336/192 |
| 4,926,151 | 5/1990 | Morinaga | 336/196 |
| 5,212,345 | 5/1993 | Gutierrez | 174/52.5 |
| 5,724,016 | 3/1998 | Roessler et al. | 336/65 |

FOREIGN PATENT DOCUMENTS

| | | | |
|---|---|---|---|
| 2585-504 | 1/1987 | France | 336/192 |
| 2236241 | 2/1974 | Germany . | |
| 8620265 | 11/1986 | Germany . | |
| 9415559 | 2/1995 | Germany . | |
| 53-147972 | 12/1978 | Japan | 336/192 |

OTHER PUBLICATIONS

Technical Digest (Western Electric) (1985) Mar. No. 76, pp. 19–20, "improved coil bobbin" F.T. Dickens.

*Primary Examiner*—Michael L. Gellner
*Assistant Examiner*—Anh Mai
*Attorney, Agent, or Firm*—Martin A. Farber

[57] ABSTRACT

A coil assembly has a coil form on which the coil winding is arranged as well as a method of contacting the coil assembly on a support member. The coil assembly is easy to produce and also permits electrical contacting, namely, the provision of electrical contacts between terminals of the coil and an external circuit in a simple and reliable manner. The coil assembly has a coil form on which two contact feet are arranged, the ends of the coil winding being fastened to the respective contact feet.

19 Claims, 1 Drawing Sheet

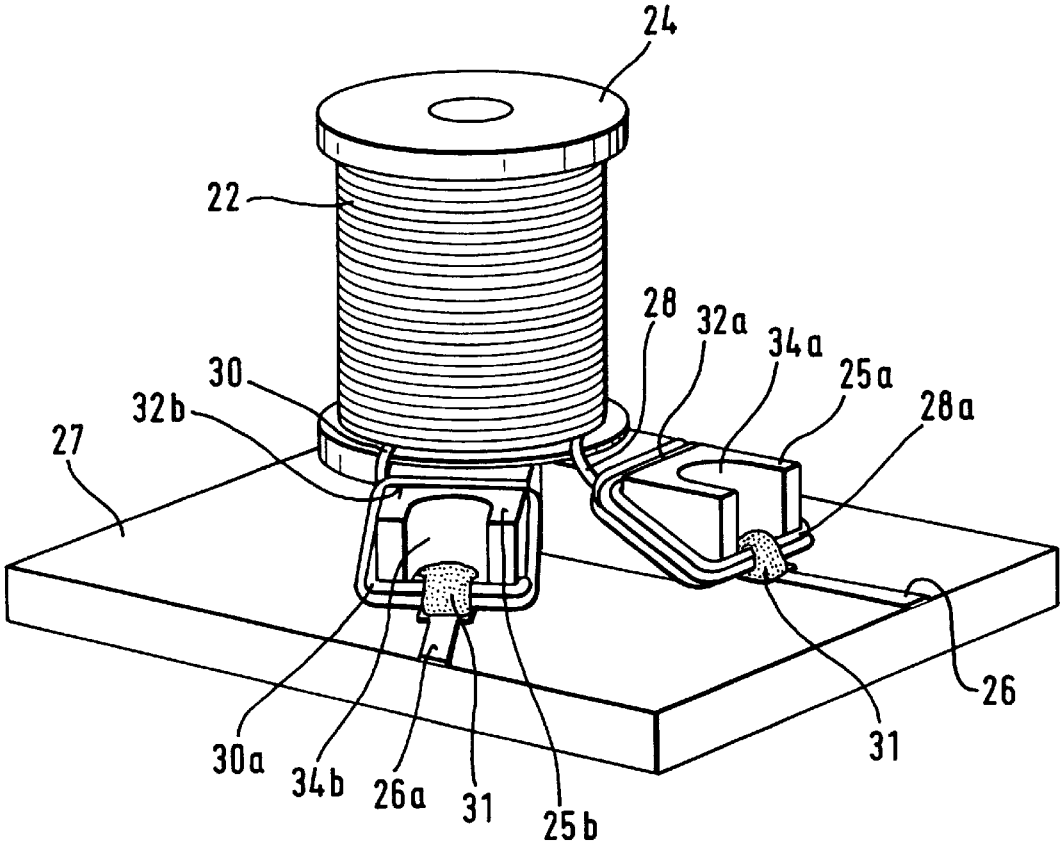
24
22
28
32a
34a
25a
28a
30
32b
27
26
31
30a
34b
26a
31
25b

COIL ASSEMBLY AND METHOD FOR CONTACTING THE COIL ON A SUPPORT BODY

FIELD AND BACKGROUND OF THE INVENTION

The present invention relates to a coil assembly having a coil form on which the coil winding is arranged on a support body, and a method of contacting, or affixing electrical leads from the coil winding to electrical contacts for connection to an external circuit.

Coils are used in a large number of measuring mechanisms in order to produce a magnetic field. For this, it is necessary that continuous current signals or current pulses be fed to the coil winding. For this purpose, the ends of the winding of the coil are connected to current conducting electric feed lines. In most cases, an end of the winding is soldered or bonded to the electric feed line.

In modern measuring instruments, the coil winding is wound on a coil form. The ends of the wire are soldered to separate contact pins. These contact pins, in their turn, are soldered to the electric feed lines. Several operations are thus necessary for each coil arrangement.

SUMMARY OF THE INVENTION

It is an object of the invention to provide a coil assembly which is simple to manufacture and permits an easy and reliable electrical contacting, namely, the provision of electrical contacts between terminals of the coil and an external circuit.

According to the invention, two contact feet (25*a*, 25*b*) are arranged on a coil form (24) and the ends (28, 30) of the coil winding (22) are fastened to contact feet (25*a*, 25*b*) respectively.

The advantage of the invention is that by the elimination of additional contact elements, cost-favorable manufacture is possible. The winding of the body of the coil can be effected in a single operation without additional expense in the manner that, first of all, the first contact foot is wrapped, then the body of the winding is wrapped, and finally the second contact foot is wrapped.

By the elimination of the contact pins, there is obtained a reduction in cost and an increase in reliability.

In a further aspect of the invention, at least one contact foot (25*a*, 25*b*) is developed in fork shape. The fork-shaped contact foot (25*a*, 25*b*) has a recess (34*a*, 34*b*) which faces away from the body of the coil.

In particular, the recess permits the accumulation of contact paste upon the contacting process, which, in view of the wide contact surface, leads to a dependable and durable contacting.

The contact foot (25*a*, 25*b*) preferably has a recess (32*a*, 32*b*) or an elevation for the receiving and fastening of the end of the winding (28, 30). This recess (32*a*, 32*b*) is arranged between the coil form (24) and the recess (34*a*, 34*b*). Below the fork-shaped contact foot there is a guide for the winding (28*a*, 30*a*) of the corresponding end of the winding (28, 30).

In one embodiment, each winding end (28, 30) is wrapped by at least one turn (28*a*, 30*a*) around a contact foot (25*a*, 25*b*). A multilayer wrapping of each contact foot leads to a reliable attachment of the corresponding end of the winding to the contact foot.

Such a suitably shaped coil form having two contact feet formed thereon bears the coil winding and assures a dependable fastening of the ends of the wire to the contact feet. The wire ends themselves are directly connected to the electric feed lines.

For the contacting on a flat circuit board, it is advantageous for the contact foot (25*a*, 25*b*) to be arranged parallel or perpendicular to the coil winding (22) at one end of the coil form (24).

In this connection, the distances of the two contact feet from each other are advisedly so selected that they correspond to the distance apart of the conductor paths on the circuit board.

The coil arrangement of the invention permits a simple contacting on a support body provided with electric feed lines in which the windings fastened on the contact foot of a winding end of the coil winding are arranged sufficiently close to the feed, and are contacted by suitable method of connection, for instance by an electrically conductive contact paste, to electric feed lines.

A mechanical contact between the winding end of the coil winding and the feed line is desirable but is not absolutely necessary.

A small slot between winding and feed line can easily be overcome by soldering with capillary effect, or welding with pressing force.

The contacting can be effected in this connection by processes such as thermocompression welding, soldering with a solder paste, reflow melting by infrared radiation, laser or thermode or conductive cement.

If the support member is a circuit board, automatic reflow soldering can be used for the contacting. The circuit board (27) is in this case preferably a flexible circuit foil or a reinforced-conductor system.

The invention also provides a method of contacting the coil assembly on a support member provided with electric feed lines, wherein the windings (28*a*, 30*a*) of a winding end (28, 30) of the coil winding (22) are fastened on the contact foot (25*a*, 25*b*) and are arranged correspondingly close to a feed line (26, 26*a*) of the support member (27), and are contacted by an electrically conductive contact paste (31) to the electric feed line (26, 26*a*).

Further according to a feature of the invention, the contacting is effected by means of a conductive paste.

According to another feature of the invention, the support member is a circuit board (27), the conductive paths (26, 26*a*) of which are electrically connected with the respective winding ends (28, 30) of the contact feet (25*a*, 25*b*).

Also according to a feature of the invention, the contact foot (25*a*, 25*b*) is soldered onto the circuit board (27).

BRIEF DESCRIPTION OF THE DRAWINGS

With the above and other objects and advantages in view, the present invention will become more clearly understood in connection with the detailed description of a preferred embodiment when considered with the accompanying drawing, the sole FIGURE of which is a perspective view of the invention.

DETAILED DESCRIPTION OF THE PREFERRED EMBODIMENT

The FIGURE shows the contacting of the coil assembly of the invention on a circuit board 27 such as used in measuring mechanisms for display systems in motor vehicles.

The coil assembly comprises a coil form 24 bearing a coil winding 22. The coil form 24 has two electrically insulating contact feet 25*a* and 25*b* which are fastened in the same plane at one end of the coil form 24 parallel to the winding 22. The contact feet 25*a* and 25*b* are of identical construction. They are fork-shaped in such manner that they have a U-shaped recess 34*a*, 34*b* facing away from the coil form 24, said recesses being open towards respective conductive paths of the circuit board 27.

Below the fork-shaped contact foot, there is a guide in the form of a groove for the windings 28*a*, 30*a* of the winding ends 28, 30 which are guided around the contact feet. In the direction of the exciting winding between coil form 24 and the recess 34*a*, 34*b*, each of the contact feet 25*a* and 25*b* has a trough-shaped recess 32*a* and 32*b* respectively for fastening the windings 28*a* and 30*a* on the corresponding contact foot.

Upon manufacture, a first end 28 of the coil winding 22 is wound several times around the first contact foot 25*a*, so that the windings 28*a* contact the conductive path 26 after the mounting on the circuit board.

After the wrapping of the first contact foot 25*a*, the coil form 24 is provided with the coil winding 22. The second contact foot 25*b* is then wrapped in the same manner as the first contact foot 25*a* with the second end 30 of the coil.

For the contacting, namely, the provision of electrical contacts between terminals of the coil and an external circuit, the contact feet 25*a* and 25*b* are placed on the circuit board 27 and electrically connected to the conductive path 26, 26*a* of the circuit board 27. The windings 28*a* in this connection contact the conductive path 26 and the windings 30*a* contact the conductive path 26*a*.

The contacting of the windings 28*a* and 30*a* of the two coil ends 28 and 30 is effected, in each case, by a solder connection 31.

The fork-shaped embodiment permits the accumulation of contact paste, in the present case solder paste, and thus assures a dependable contacting of the conductive paths with the ends of the winding.

In addition to an automatic soldering process, the contacting can, however, also be effected by conductive cement.

We claim:

1. A coil assembly suitable for positioning a coil relative to a support member having electric feed lines, the coil assembly comprising:

a coil form with a coil winding thereon;

two insulating contact feet disposed on the coil form, a bottom of each contact foot making contact with said support member upon a placing of said coil assembly upon said support member; and wherein the coil winding has ends which are fastened to respective ones of the contact feet;

at least one of said contact feet is formed in fork shape defining a U-shaped recess with an opening of the recess facing away from the coil winding;

each of the winding ends is wrapped with at least one turn around a corresponding one of the contact feet, said one turn crossing said opening at the bottom of said corresponding foot at a location of a corresponding one of said feed lines; and said U-shaped recess at said opening provides clearance between said one turn and said corresponding foot to enable an electrical connection between said one turn and said corresponding feed line.

2. A coil assembly according to claim 1, wherein in the one contact foot, the U-shaped recess faces away from a body of the coil winding.

3. A coil assembly according to claim 2, further comprising an elevation or a trough-shaped recess on said one contact foot arranged between the coil form and the U-shaped recess for receiving and fastening of an end of the winding wrapped thereon.

4. A coil assembly according to claim 3, further comprising a guide located adjacent the bottom of the fork-shaped contact foot adjacent an end of the U-shaped recess having said opening remote from said coil for the wrapping of the corresponding end of the coil winding, said elevation or trough-shaped recess being on top of said one contact foot, wherein said corresponding end is wrapped and fastened at said elevation or trough-shaped recess and said guide, with said at least one turn thereof extending from said top to said bottom of said one contact foot inclined with respect to a lengthwise direction of said one contact foot, with said at least one turn having a portion passing under said U-shaped recess at the bottom of said one contact foot adjacent said open end of the U-shaped recess and being adapted for conductive contact with the electrical feed line on the support member when said one contact foot is disposed on said support member with said feed line crossing said U-shaped recess and said portion of said at least one turn.

5. A coil assembly according to claim 4, further comprising a conductive connection of said portion of said at least one turn of said corresponding end of the coil winding and said feed line at said U-shaped recess.

6. A coil assembly according to claim 4, wherein said guide is a groove.

7. A coil assembly according to claim 2, wherein a corresponding winding end having a portion of said at least one turn wrapped around fork-shaped ends of the fork-shaped one contact foot passes under the U-shaped recess adjacent an end of the U-shaped recess having said opening so as to contact or be spaced by a small slot from a substantially flat corresponding feed line on the support member when the bottom of said one contact foot is placed on the support member with said corresponding feed line crossing said U-shaped recess and said portion of the winding end turn.

8. A coil assembly according to claim 1, wherein said one contact foot has an elevation for receiving and fastening of an end of the winding.

9. A coil assembly according to claim 1, wherein said one contact foot has a trough-shaped recess for receiving and fastening of an end of the winding.

10. A coil assembly according to claim 1, further comprising a guide located below the fork-shaped contact foot for receiving a corresponding winding end of the coil winding wrapped thereon.

11. A coil assembly according to claim 10, wherein said guide is a groove.

12. A coil assembly according to claim 1, wherein each of the contact feet is arranged parallel or perpendicular to the coil winding at one end of the coil form.

13. A method of contacting a coil assembly, having a coil winding and insulating contact feet, on a support member provided with electric feed lines, comprising steps of forming at least one of said contact feet in fork shape defining a U-shaped recess with an opening facing away from the coil winding, a bottom of each contact foot making contact with said support member upon a placing of said coil assembly upon said support member;

fastening ends of the coil winding on respective ones of the contact feet by wrapping each of the winding ends with at least one turn around a corresponding one of the contact feet, said one turn crossing said opening at the bottom of said corresponding foot;

arranging the at least one contact feet with their said openings respectively adjacent to the feed lines of the support member; and contacting the ends of the coil winding to respective ones of the electric feed lines at the locations of respective ones of the openings of the contact feet, wherein said U-shaped recess provides clearance between said one turn and said corresponding contact foot to enable an electrical connection between said one turn and said corresponding feed line.

14. A method according to claim 13, wherein the contacting is effected by means of a conductive paste.

15. A method according to claim 13, wherein the contacting is effected by soldering.

16. A method according to claim 13, wherein the contacting is performed by welding.

17. A method assembly according to claim 13, wherein the support member is a circuit board, and said contacting includes electrically connecting the conductive paths with the respective winding ends at the contact feet.

18. A method according to claim 17, further comprising a step of soldering the contact feet onto the circuit board.

19. A method according to claim 13, wherein the support member is a circuit board, the circuit board comprising a flexible circuit foil or a reinforced-conductor system; and said contacting comprises automatic reflow soldering.

* * * * *